United States Patent [19]

Shima

[11] Patent Number: 5,040,384

[45] Date of Patent: Aug. 20, 1991

[54] METHOD FOR SETTING UP A FABRIC ON A FLAT KNITTING MACHINE

[75] Inventor: Masahiro Shima, Wakayama, Japan

[73] Assignee: Shima Seiki Mfg., Ltd., Wakayama, Japan

[21] Appl. No.: 470,087

[22] Filed: Jan. 25, 1990

[30] Foreign Application Priority Data

Feb. 8, 1989 [JP] Japan ..... 1-30354

[51] Int. Cl.[5] ..... D04B 15/88

[52] U.S. Cl. ..... 66/149 R

[58] Field of Search ..... 66/149 R, 150

[56] References Cited

U.S. PATENT DOCUMENTS

| | | | |
|---|---|---|---|
| 3,375,683 | 4/1968 | Joseph | 66/149 R |
| 3,376,716 | 4/1968 | Joseph | 66/150 |
| 3,618,343 | 11/1971 | Essig | 66/149 R |
| 4,488,146 | 12/1984 | Shima et al. | 66/149 R |
| 4,503,690 | 3/1985 | Goller et al. | 66/149 R |

FOREIGN PATENT DOCUMENTS

| | | | |
|---|---|---|---|
| 1221757 | 5/1961 | Fed. Rep. of Germany | 66/149 R |
| 2427117 | 2/1976 | Fed. Rep. of Germany | 66/149 R |
| 7315705 | 5/1973 | Japan | 66/149 R |
| 51-2979 | 1/1976 | Japan . | |
| 59-21762 | 2/1984 | Japan . | |
| 0185851 | 9/1985 | Japan | 66/149 R |
| 3075157 | 4/1988 | Japan | 66/149 R |
| 69470 | 10/1914 | Switzerland | 66/150 |
| 15345 | 12/1885 | United Kingdom | 66/150 |
| 958075 | 5/1964 | United Kingdom | 66/149 R |
| 968001 | 8/1964 | United Kingdom | 66/150 |
| 2118216 | 10/1983 | United Kingdom | 66/149 R |

*Primary Examiner*—W. C. Reynolds
*Assistant Examiner*—John J. Calvert
*Attorney, Agent, or Firm*—Tilton, Fallon, Lungmus

[57] ABSTRACT

A set-up comb 6, disposed below the gap 3 between needle beds in a V-bed falt knitting machine, comprises a comb bed 5 and a plurality of setting-up needles 4 mounted to the comb bed 5. Each setting-up needles comprises a needle body 10 fixed to the comb bed 5 and a slider 11 slidably combined with the needle body 10. The needle body 10 has a hook accommodating protrusion 20 formed at its front end for releasably receiving therein a hook 12 formed at the upper end of the slider 11. When a double-stroke course set-up yarn 75*a*, 75*b* has been laid in zigzag pattern between the front and rear needle beds 2*f*, 2*r* in such a way that the forward- and back-course portions of the yarn 75*a*, 75*b* are crossed at a plurality of positions above the gap 3, the set-up comb 4 is elevated to cause the hooks 12 of individual slider 11 to hook the yarn 75*a*, 75*b* at the crossing sites thereof, so that the set-up yarn 75*a*, 75*b* can be lowered by the set-u comb 6 to a level below the gap 3. When the slider 11 is elevated, the hooks 12 retract into the hook accommodating protrusions 20 of corresponding needle bodies 10 and thus the set-up yarn 75*a*, 75*b* engaged by the hooks 12 are disengaged from the hooks.

2 Claims, 10 Drawing Sheets

R1
R2
R3
R4
F1
F2
F3
F4
75
75a
75b
75c
75d
106

METHOD FOR SETTING UP A FABRIC ON A FLAT KNITTING MACHINE

BACKGROUND OF THE INVENTION

The present invention relates to a method and means for setting up a fabric on a flat knitting machine.

Flat knitting machines have an advantage that they permit widening and narrowing operation, so that fabrics can be fashioned as desired.

However, when fashioning is carried out on a batch basis, the knitting operation involves the following problem at set-up stage. If the final-course width of a fashioned fabric is smaller than that of the set-up course of a next fabric to be fashioned, for example, it is necessary that a large number of waste courses should be provided between the final course of the knitted fabric and the set-up course of the next batch fabric in such a way that the waste courses are sequentially widened until the set-up course width of the next batch fabric is reached. Otherwise, the set-up course of the next batch fabric will be subject to partial stretch and no widthwise uniformity can be obtained in knit construction.

Therefore, in order to reduce the number of waste courses so that no such problem as pointed out above will be encountered even if such fashioning is carried out on a batch basis, there have been proposed a number of set-up methods and a number of set-up devices for carrying out those methods.

For example, Japanese Patent Publication No. 51-2979, as well as Japanese Patent Application Laid-Open Publication No. 59-21762, discloses a (see present FIGS. 21–23) such that a hook-type comb 103 comprising a plurality of set-up needles (crochet needles) 101 each having a hook 102 at its front end, as shown in FIG. 21, is employed in such a way that set-up needles caused to project their front ends upwardly through the 3 between the front and rear needle beds *2f, 2r*. In this knitting needles R on one of the needle beds (for example, on the rear needle bed) are brought to their advanced and then a set-up yarn 105 for a first knitting course is supplied between the array of the setting-up needles 101 and the array of the knitting needles R. Thereafter, the knitting needles R are retreated and simultaneously the front ends of the setting-up needles 101 are lowered to a level the gap 3 so that the set-up yarn 105 is laid in zigzag between the set-up needles 101 and the knitting needles R, the set-up comb 103 then being gradually lowered the set-up yarn 105 remains engaged by hooks 102 of the needles 101, whereby a next and subsequent courses can knitted.

Japanese Patent Application Laid-Open Publication No. 45-24306 (U.S. Pat. No. 3,376,716) disclosed another technique. There, a double-comb type set comb consisting of a combination of a comb-shaped array of needles and a comb-shaped array of pin-like needles (not , is employed in such a way that the double-comb type set-up comb is caused to project upward through the gap between the front and rear needle beds while being held in closed position and knitting needles on one of the needle beds are brought to their advanced position passing through the clearance between the eye needle and pin-like needle arrays of the double comb. Thereafter, a set-up yarn for a first knitting course is supplied between the double comb array and the knitting needle array in the same way as in the case of the first mentioned prior-art technque. Then the knitting needles are moved to their retreated position, whereby a set-up yarn course in zigzag pattern is laid between the knitting needles and the set-up comb. The set-up comb is then lowered to a level below the gap between the needle beds so that sinker loops of the set-up course are hooked by the upper ends of eye needles of the set-up comb in closed condition. Subsequently, the set-up comb is gradually lowered to enable knitting of a next and subsequent courses.

In these methods using such known devices, knitting needles only on one of the needle beds are brought to their advanced position and set-up needles are caused to project upward through the gap. As seen in FIGS. 21–23, sinker loops S of the set-up yarn 105 supplied between the set-up needles projecting through the gap and the knitting needles on the one needle bed are hooked by the front end of the set-up comb. As the set-up comb is gradually lowered, a next and subsequent courses are knit. As such, these prior-art techniques involve the following problems.

a) Usually, set-up yarn 105 is supplied between the knitting needles and the set-up comb while being gripped by a suitable gripper 106 as shown in FIG. 22. The starting feed end 105*a* for the set-up yarn 105 is released from the gripper 106 when the next several and ten-odd courses have been knitted. Therefore, set-up course loops (sinker loops) $S_1$, $S_2$, etc., adjacent the starting feed end of set-up yarn 105 are likely to be stretched by the set-up comb 103 as knitting progresses (FIG. 23).

b) Therefore, walewise loops formed in succession to the needle loops $N_1$, $N_2$ etc. at the starting end side of the set-up yarn 105 are likely to have no sufficient take-down tension applied thereto and, accordingly, a newly set-up fabric 150 is likely to have no uniform tension given throughout its width. This may often result in distortion (bowing) with the fabric 150 (FIG. 23).

c) If sinker loops $S_1$, $S_2$ etc., which are under tension by the set-up comb 103 are stretched, an upper portion 150*a* adjacent the selvage of the fabric 150 (FIG. 23) has no sufficient tension applied and, therefore, may be often liable to loop dropping in the course of knitting.

The following problems have also been found with the above mentioned prior-art set-up method and device in which a set-up yarn must be supplied to the set-up comb in such condition that the front end of the set-up comb projects substantially above the gap between the front and rear needle beds.

d) The required space above the gap for feeder passage is partially blocked by the front end of the set-up comb and, therefore, at a level above the gap it is necessary to shift the yarn feeder for set-up yarn to keep it away from the set-up comb. As such, yarn feeders available for set-up yarn feed are limited in number and position, because they are required to shift at a level above the gap in order to avoid the possibility of interference with the set-up comb. If the yarn feeder for set-up yarn happens to contact the set-up comb projecting above the gap, there may be the trouble of set-up needle breakage or bending.

e) When the set-up comb is thrusted to a level above the gap, if any yarn feeder is present on the way, the top end of the set-up comb is subject to damage by the yarn feeder. Therefore, when thrusting the set-up comb upward beyond the gap, it is necessary that all the yarn feeders must be kept away from the set-up comb range. This means that each yarn feeder must be previously moved considerably sideward to a position at which the yarn feeder will not collide with the set-up comb.

f) The conventional set-up comb having hook-type setting-up needles such that set-up needles must be thrusted substantially upward beyond the gap between the needle beds for set-up yarn supply. Naturally, therefore, the set-up needles are considerably long. If a long fabric is lowered by the set-up comb, the fabric engaged by setting-up needles is subject to a considerable force acting in a direction of fabric narrowing. Therefore, the trouble with the prior-art set-up comb having long set-up needles is that the needles are subject to deformation. If a setting-up needle is deformed, it is often difficult to disengage the set-up comb from the loop by mechanical means.

g) The conventional set-up comb having hook-type setting-up needles has a disadvantage that it cannot disengage by itself the set-up course loops which are in engagement with its top end and, therefore, it requires some means for disengaging the loops from its top end. However, such means cannot be provided immediately below the needle beds. In order to disengage the hooks of the set-up comb from the fabric there must be some means for holding the fabric at a level above the hooks of the set-up comb (e.g., means for gripping and taking down the fabric). Therefore, with the prior-art arrangement, it is impossible to disengage the set-up comb from the lower end of the fabric, in case the fabric knitted is somewhat short in length.

h) In this respect, the above mentioned double-comb type set-up comb has an advantage that it is possible to release sinker loops of the set-up course engaged by the top end of the set-up comb by lowering pin-type needles and removing the same through eyelets of eye needles, it being thus possible to disengage the set-up comb from the lower edge of the fabric, even if the fabric knitted is somewhat short in length. However, the difficulty with this latter mentioned set-up device is that accurate control is required for insertion and removal of the front end of each pin-like needle having a certain length relative to the eyelet formed at the curved front end of a corresponding eye needle having a larger length. This, thus, requires a high degree of precision with respect to the arrangement of two comb arrays subject to relative displacement.

SUMMARY OF THE INVENTION

It is an object of the invention to provide a novel set-up method which eliminates the foregoing problems a) to c) with the prior art and which permits a fabric to be lowered under uniform tension applied throughout its entire width, without causing any slack to sinker loops adjacent the starting end of a set-up course as above mentioned.

It is another object of the invention to provide a novel set-up method which eliminates all of the above mentioned problems d) to h) involved in the prior-art set-up methods and devices, and a novel set-up means which can be advantageously employed in carrying out the method.

In order to accomplish the foregoing objects, according to the invention there is provided a set-up method for setting up a fabric on a flat knitting machine such that when a set-up course is to be set up on a flat knitting machine having front and rear needle beds, (a) a double-stroke set-up course in the form of a ribbed course of "a 1×3 draw-off construction" is formed of a set-up yarn in such a way that a forward-stroke ribbed-course set-up yarn and a back-stroke ribbed-course set-up yarn laid between the front and rear needle beds in zigzag pattern cross each other above the gap between the needle beds, (b) thereafter, needles of a set-up comb are caused to act on the forward- and back- stroke course set-up yarns at their crossing portions above the gap to lower the crossing portions of the double-stroke ribbed course yarns to a level below the gap, and (c) in succession to the terminating end of the back-stroke ribbed course, one double-stroke set-up course yarns are fed to the needles on which the one double-stroke ribbed course yarns are laid, being thereby knitted into a tubular course, and subsequently a fabric is knitted in succession to the tubular course.

In order to accomplish the foregoing objects, according to the invention there is also provided a set-up means in a flat knitting machine of the double bed type including a set-up comb upward and downward movably disposed beneath the gap between needle beds. The set-up comb comprises a comb bed and a plurality of setting-up needles mounted in the comb bed, and has drive means mounted to the comb bed for moving the setting-up needles upward and downward. The set-up means includes:

(a) set-up needles consisting of a needle body and a slider slidable lengthwise of the needle body, with the needle body fixed to the comb bed, and a portion of the needle body projecting upward from the comb bed.

(b) the slider is upwardly and downwardly movable at a predetermined stroke in relation to both the needle body and the comb bed, and has a forwardly projecting hook at its upper end portion;

(c) the portion of the needle body which projects upward from the comb bed is formed at its upper end with a forwardly facing hook accommodating protrusion, such that when the slider is thrusted to its elevated position, the hook portion of the slider is received in the protrusion so that said hook portion is kept at an inoperative position relative to knitting yarn. When the slider is lowered from said elevated position, the hook portion of the slider is withdrawn from the protrusion and exposed at an operative position relative to knitting yarn. The hook accommodating protrusion has its top forwardly sloped downward, while its underside is forwardly sloped upward; and (d) the slider is equipped with a slider lifting device for moving the slider upward and downward relative to both the needle body and the comb bed, thereby causing the hook portion of the slider to be withdrawn from being received into said hook accommodating protrusion of the needle body.

The present invention is unlike the prior-art set-up method in which knitting needles on one (not both) of the front and rear needle beds are first advanced and the set-up comb is thrusted upward beyond the gap, and thereafter a single-course set-up yarn is supplied to the knitting needles and the projecting set-up comb, with the single-course set-up yarn being hooked by the set-up comb for tensioning. Here, the set-up method according to the present invention is such that three-needle spaced knitting needles on both front and rear needle beds are advanced to their operative position. In that condition, a double-stroke course set-up yarn is laid between the needles on the two beds so that a forward-stroke ribbed course laid in zigzag pattern between the needles on the two beds and a back-stroke ribbed course laid in zigzag pattern between the needles on the two beds are combined together at the gap. There, the set-up comb is caused to act on the fabric at crossing portions of the double course yarns to lower the fabric. The set-up yarn is placed between needles on the two beds at a turning point from the forward course to the back course and at a point for shifting from the back course to a next succeeding knitting course. After the terminal end of the back set-up course in particular is reached, another double-stroke course set-up yarn is supplied to the needles on both beds which are in engagement with the previous double-stroke set-up course yarn for tubular course knitting, beginning from a particular needle engaging the starting portion of the ribbed-course yarn.

Thereafter, fabric knitting starts in succession to the tubular course knitting. Therefore, the one setting-up needle by which the lower end of the fabric is set up in accordance to the method of the invention is in engagement with a set-up course having a loop formed outside the site at which the needle engages the set-up yarn. Further, as stated above, a further double-stroke set-up course (tubular course) is knitted in succession to the previous double-stroke set-up course (ribbed course), and then subsequent knitting courses are fashioned. Therefore, the loop formed outside the one set-up needle is not subject to being stretched by the setting-up needle more than other loops to be lowered by other setting-up needles, when it is lowered by the one setting-up needle.

According to the set-up method of the present invention in which the set-up comb is caused to act on the fabric from behind at crossing portions of a previously formed double-stroke set-up course which is laid over the gap between the front and rear needle beds in order to lower the fabric, the set-up comb need not be thrusted upward beyond the gap which serves as a feeder passage, such as when a set-up yarn is fed to needles.

This means that, according to the method of the invention, set-up yarn can be supplied to needles whatever yarn feeder may be used and which is located at any position above the gap, and that a double-stroke set-up course (ribbed course) previously formed of yarn fed from a feeder located at a desired position is hooked by the set-up comb and lowered to a level beneath the gap, whereby a fabric can be set up.

Each of the setting-up needles in the set-up means described in detail below comprises a needle body having at its upper end a forward facing hook accommodating protrusion, and a slider having at its upper end a forward facing hook which is slidably combined with the needle body. When the slider is in its lowered position relative to both the needle body and the comb bed, the hook portion of the slider is withdrawn from the hook accommodating protrusion of the needle body so that the hook portion forwardly projects from the front of the needle body at a position below the hook accommodating protrusion. When the slider is elevated relative to both the needle body and the set-up comb, the hook portion is housed in the hook accommodating protrusion. The forwardly facing hook accommodating protrusion at the upper end of the needle body has its top forwardly sloped down and its underside forwardly sloped up so that when the slider is elevated or lowered, the hook portion is withdrawn downward from or retreated upward into the protrusion. Therefore, the set-up comb equipped with a plurality of setting-up needles of such construction can be caused to engage or disengage from set-up yarn through the hook portion of the slider by being elevated or lowered.

When each hook portion of the set-up comb is to be brought in engagement with crossing portions of such forward-stroke course set-up yarn (ribbed course yarn) and back-stroke course set-up yarn (ribbed course yarn) as mentioned above, the slider lifting device is actuated so that each relevant slider is elevated relative to the needle body. Then, while keeping the slider in that condition, the set-up comb is elevated to thrust the setting-up needle upward beyond the gap, whereupon the upper end of the setting-up needle is guided by the forwardly down-sloped top surface of the hook accommodating protrusion to a position behind the crossing portions of the double-stroke set-up course yarn (ribbed course yarn), with the hook accommodating protrusion being brought to a level above the crossing portions. The set-up comb is elevated until such condition is reached, and then the slider lifting device is again operated to lower the slider in relation to both the needle body and the comb bed. At same time, the set-up comb is lowered. The hook of the slider is withdrawn from the hook accommodating protrusion so as to be exposed below the protrusion. It is now possible to allow the hook to engage the double-stroke set-up course yarn at crossing portions thereof. Subsequently, in the same manner as in the case where the conventional set-up device is employed, the set-up comb is gradually lowered in proportion to the speed of fabric knitting, and thus a desired tension can be applied to a fabric to be knitted in succession to the set-up course.

When disengaging the set-up comb from the fabric knitted in above described manner, the slider lifting device is operated to elevate the slider in relation to both the needle body and the comb bed, whereupon the hook portion of the slider is received into the hook accommodating protrusion of the needle body so that the set-up course yarn of the fabric is disengaged from the hook. The set-up course yarn thus disengaged from the hook is cast off upwardly along the forwardly upward slope formed on the underside of the protrusion, without being caught by the protrusion. Thus, the lower end of the knitted fabric is completely disengaged from the set-up comb.

BRIEF DESCRIPTION OF THE DRAWINGS

FIG. 21 is a fragmentary side view of a set-up device; FIG. 22 is a view showing a set-up course forming according to the conventional method; and FIG. 23 is a construction view showing a portion adjacent a starting feed end of a fabric knitted according to the conventional method.

DESCRIPTION OF THE PREFERRED EMBODIMENT

The set-up method in accordance with the invention can be carried out by employing known set-up means with some improvements incorporated therein which may easily be thought of by any person skilled in the art. However, the use of the set-up means according to the invention permits the set-up method of the invention to be carried out more smoothly.

In the following description, one preferred embodiment of the set-up means will first be explained and, thereafter, the method of the invention for setting up knitted fabric by employing the device will be explained by way of example.

Figure 20:
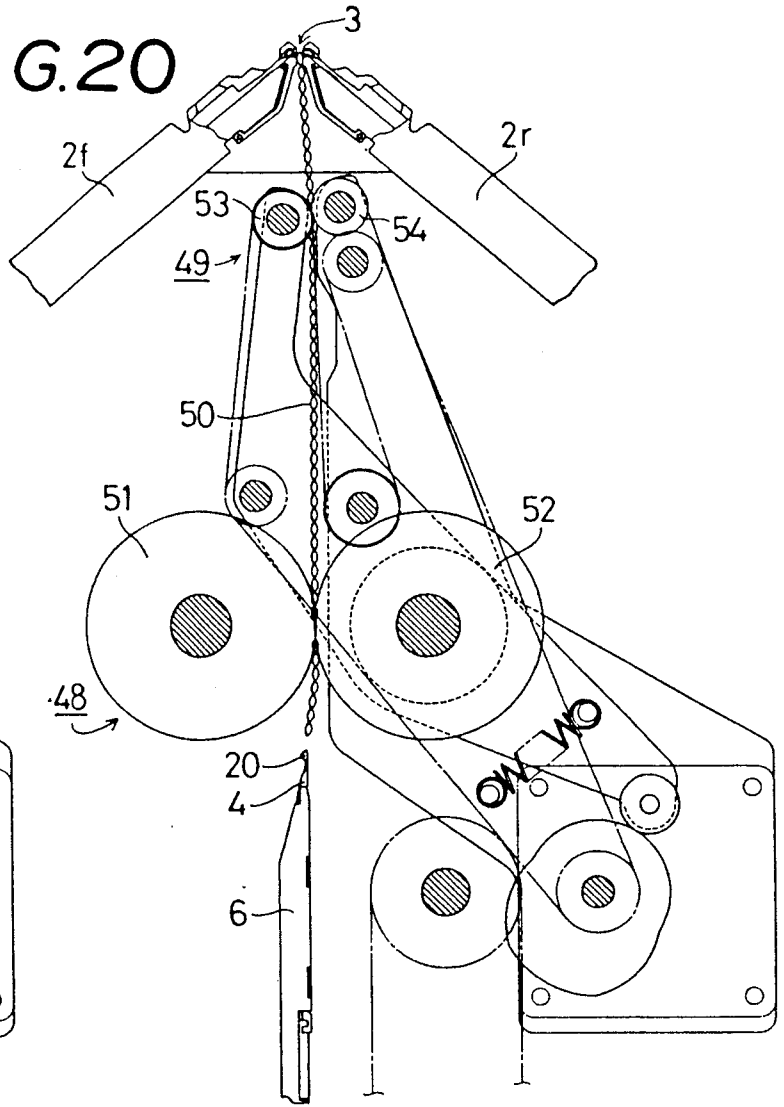
FIG. 20 is a side view showing the set-up means as seen when the set-up comb is disengaged from the fabric.

Referring to FIGS. 1 through 14, inclusive, which illustrate the embodiment, a set-up comb 6 is up and down movably disposed beneath a gap 3 between a pair of needle beds 2*f*, 2*r* of a V-bed flat knitting machine 1. The set-up comb 6 has a comb bed 5 and a plurality of setting-up needles 4 arranged thereon. The flat knitting machine 1 has two side frames 1*a* to which are fixed upwardly extending rails 7, 7 (FIG. 2) with sliding blocks 8 fitted thereon for slide engagement therewith. The comb bed 5 of the set-up comb 6 has its lower portion fixed at opposite sides to the sliding blocks 8. An upward and downward drive chain 9 is connected to the sliding blocks 8 for driving the set-up comb 6 to move vertically between a desired elevated position and a desired lowered position (FIG. 1), so that individual setting-up needles of the set-up comb 6 are vertically displaceable between an elevated position (at which their upper ends project upward beyond the gap 3—FIG. 1) and a lowered position (at which their upper ends are positioned lower as desired—as shown in FIG. 20, for example).

The set-up comb 6 will be described in further detail. Each setting-up needle 4 comprises a needle body 10 which is flat-configured in side elevation (FIG. 6) and a slider 11 which is also flat-configured in side elevation (FIG. 5), the slider 11 being slidably combined with the needle body 10 for slide movement lengthwise of the latter (FIGS. 7 to 10).

The slider 11 is formed at its upper end with a forward oriented hook 12 and at lower end with an engaging portion 13 for connecting the slider 11 to a slider lifting mechanism which will be described hereinafter, the engaging portion 13 being partially notched.

The needle body 10 has a vertically extending groove 14 for slidably receiving the slider 11 lengthwise thereof which is open rearward, and rearwardly projecting protrusions 15, 16 for vertically immovably securing the needle body 10 to the comb bed 5 through a strap 23*a*. The latter is releasably insertable into the comb bed 5, as will be described hereinafter. The slider 11 is received in the groove 14 of the needle body 10 in such a manner that it is vertically slidable at least over a predetermined stroke $\alpha$ in relation to the needle body 10.

A front portion of the needle body 10 adjacent the upper end thereof is partially cut away to form a forward facing recess 17, above which there is formed a forward facing protrusion 20 for accommodating the hook 12. The hook accommodating protrusion 20 is such that the hook portion 12 of the slider 11 is housed therein when the slider 11 is vertically moved to a topmost elevated position within the needle body 10 (see FIGS. 11 and 13). The recess 17 is such that when the slider 11 is lowered slightly (distance $\alpha$) from the topmost elevated position within the needle body 10, the hook portion 12 of the slider 11 is withdrawn from the hook accommodating protrusion 20 so that it can be so exposed in the recess 17. There hook portion 12 assumes a projecting attitude forwardly of the front of the needle body 10.

Figure 13:
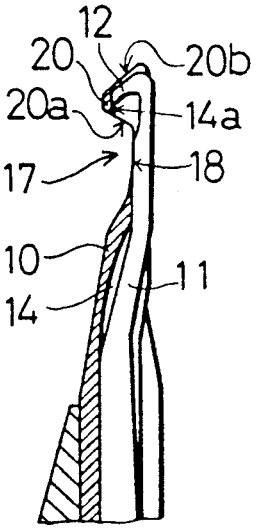
FIG. 13 is an enlarged view of portion XIII in FIG. 11.
Figure 14:
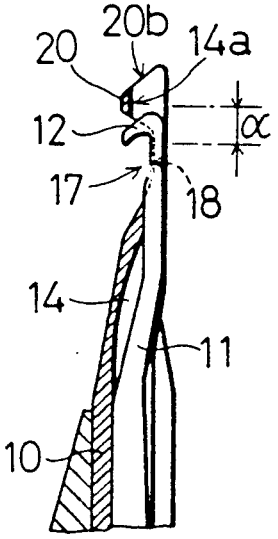
FIG. 14 is an enlarged view of portion XIV in FIG. 12.

In order to allow the hook portion 12 of the slider 11 to be moved from the hook accommodating protrusion 20 into the recess 17 and vice versa, at the front side of the needle body 10 at which the recess 17 is formed there is provided an aperture 18 which is formed by cutting away a bottom portion of the vertical groove 14 (FIGS. 13 and 14). Further, in the present embodiment, a bottom portion 14*a* of the groove 14 at the forward end of the slider accommodating protrusion 20 remains uncut (FIGS. 13 and 14). Therefore, each setting-up needle 4 of the present embodiment is of such arrangement that when the hook portion 12 of the slider 11 is received into the slider accommodating protrusion 20, after its movement from its exposed position in the recess 17 past the aperture 18 opening below the protrusion 20, the front end of the hook 12 runs onto the bottom portion 14*a* of the groove so that an upper portion of the slider 11 is slightly bent rearwardly. In this condition, the front end of the hook 12 is held in abutment against the groove bottom portion 14*a* through elastic deformation of the upper portion of the slider 11.

The top 20*b* of the hook accommodating protrusion 20, that is, the upper end of the needle body 10, is sloped down forward so that it can pass through a clearance between the rear needle bed 2*r* and a set-up course yarn 50 trained over the gap 3 between needles on the front and rear needle beds 2*f*, 2*r* and interlocked, whereby the setting-up needle 4 is allowed to thrust its upper end upward beyond the set-up course yarn without hooking the yarn 50. The underside 20*a* of the hook accommodating protrusion 20, as will be described hereinafter, is sloped up forward to enable the disengagement of set-up course yarn 50 from the setting-up needle.

Figure 3:
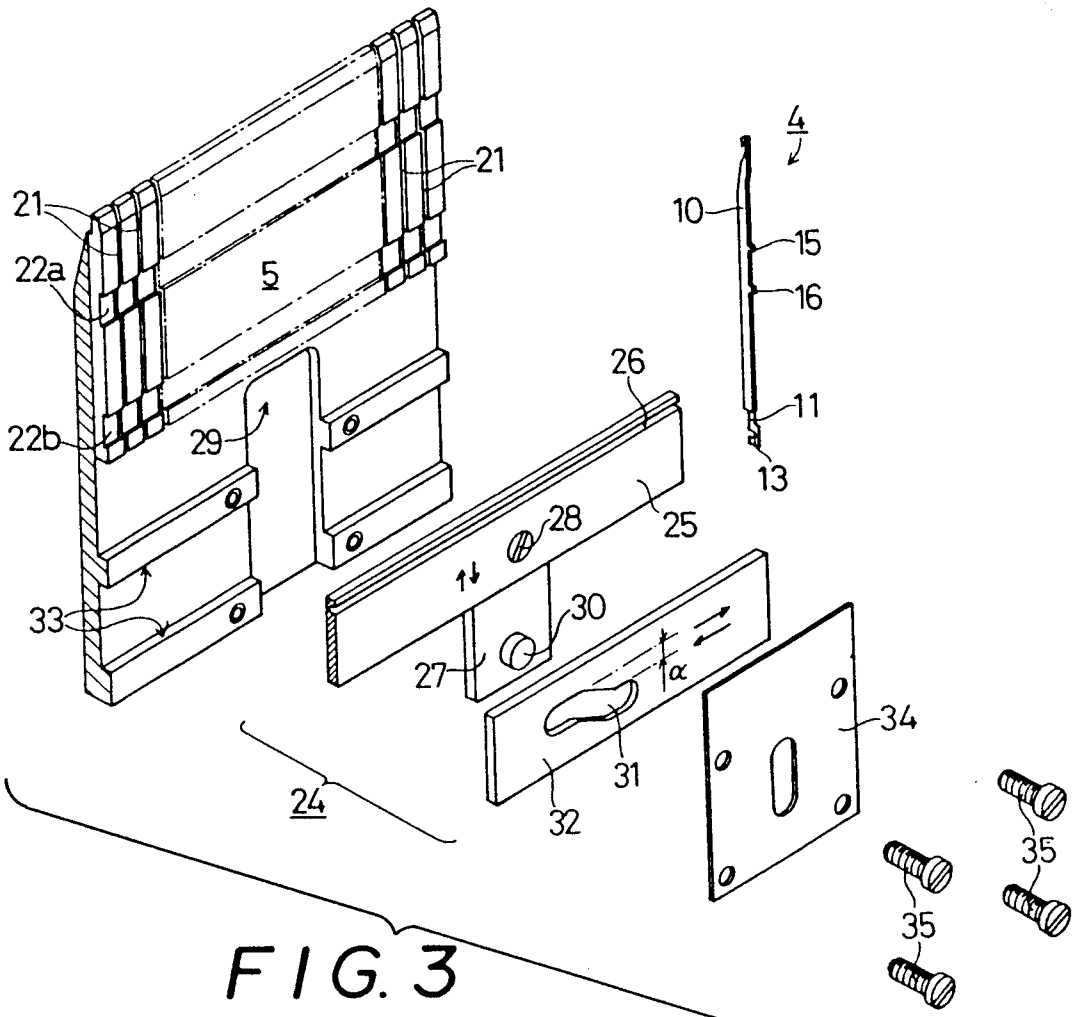
FIG. 3 is an exploded perspective view taken on portion III in FIG. 2.
Figure 5:
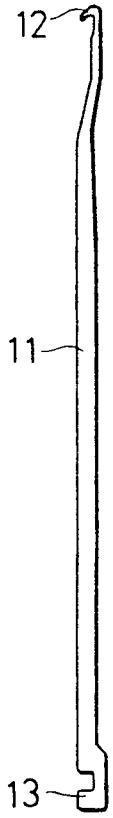
FIG. 5 is a side view of a slider.
Figure 6:
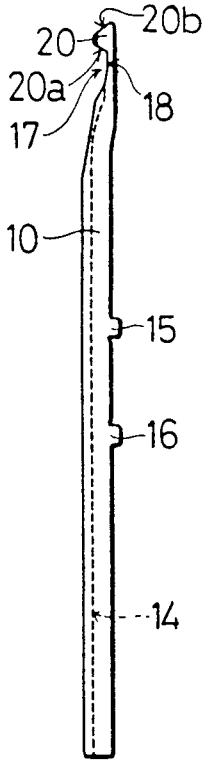
FIG. 6 is a side view of a needle body.
Figure 7:
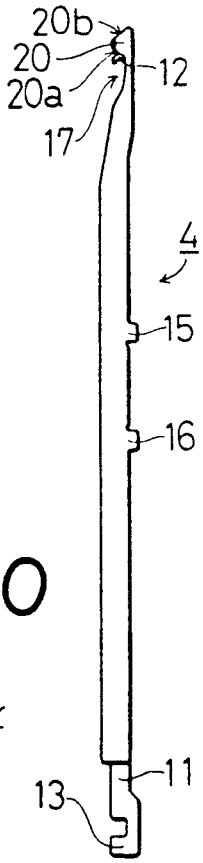
FIG. 7 is a side view of a setting-up needle.
Figure 8:
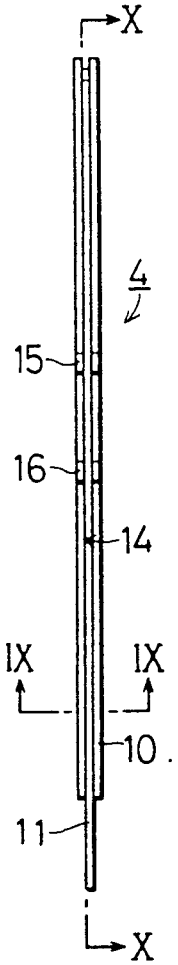
FIG. 8 is a rear view thereof.
Figure 9:
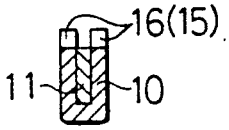
FIG. 9 is a section taken along line IX—IX in FIG. 8.
Figure 10:
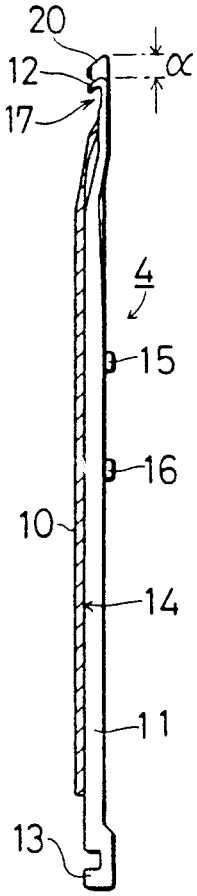
FIG. 10 is a section taken along line X—X in FIG. 8.
Figure 11:
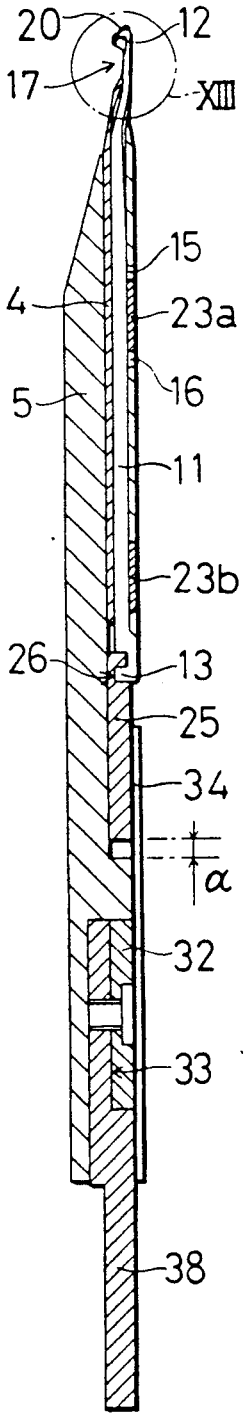
FIG. 11 is a section taken along line XI—XI in FIG. 2 showing the slider in elevated condition.

On the comb bed 5 are mounted, in parallel arrangement, a plurality of setting-up needles 4 each consisting of a combination of a needle body 10 and a slider 11 of the above described construction through mounting means of such construction as will be described below. As FIG. 3 illustrates, the comb bed 5 is formed on its back side with a plurality of needle grooves 21 arranged in parallel for securing needle bodies 10 of individual setting-up needles 4. Each needle groove 21 is configured to receive a corresponding setting-up needle 4 in such a way that an upper end portion of the needle body 10 projects upwardly beyond the upper edge of the comb bed 5, the remaining portion of the needle body 10 being fitted in the groove 21.

Further on the back side of the comb bed 5 there are formed two dovetail grooves 22*a*, 22*b* extending transversely of the needle grooves 21 and behind individual needle bodies 10 (FIG. 3). Two strap elements 23*a*, 23*b* are individually removably fitted in the grooves 22*a*, 22*b*, whereby the setting-up needles 4 are secured to the comb bed 5 as their body 10 portions are fitted in the needle grooves 21 (FIG. 4).

Again, on the back side of the comb bed 5 in which a plurality of setting-up needles 4 are arranged in parallel in manner as above mentioned, there is disposed below the plurality of setting-up needles 4 a slider lifting device 24. That device 24 moves individual sliders 11 upward and downward in relation to both corresponding needle bodies 10 and the comb bed 5 thereby causing hook portions 12 of the sliders 11 to be received into and withdrawn from hook accommodating protrusions 20 of the corresponding needle bodies 10, which will be described hereinbelow.

Figure 2:
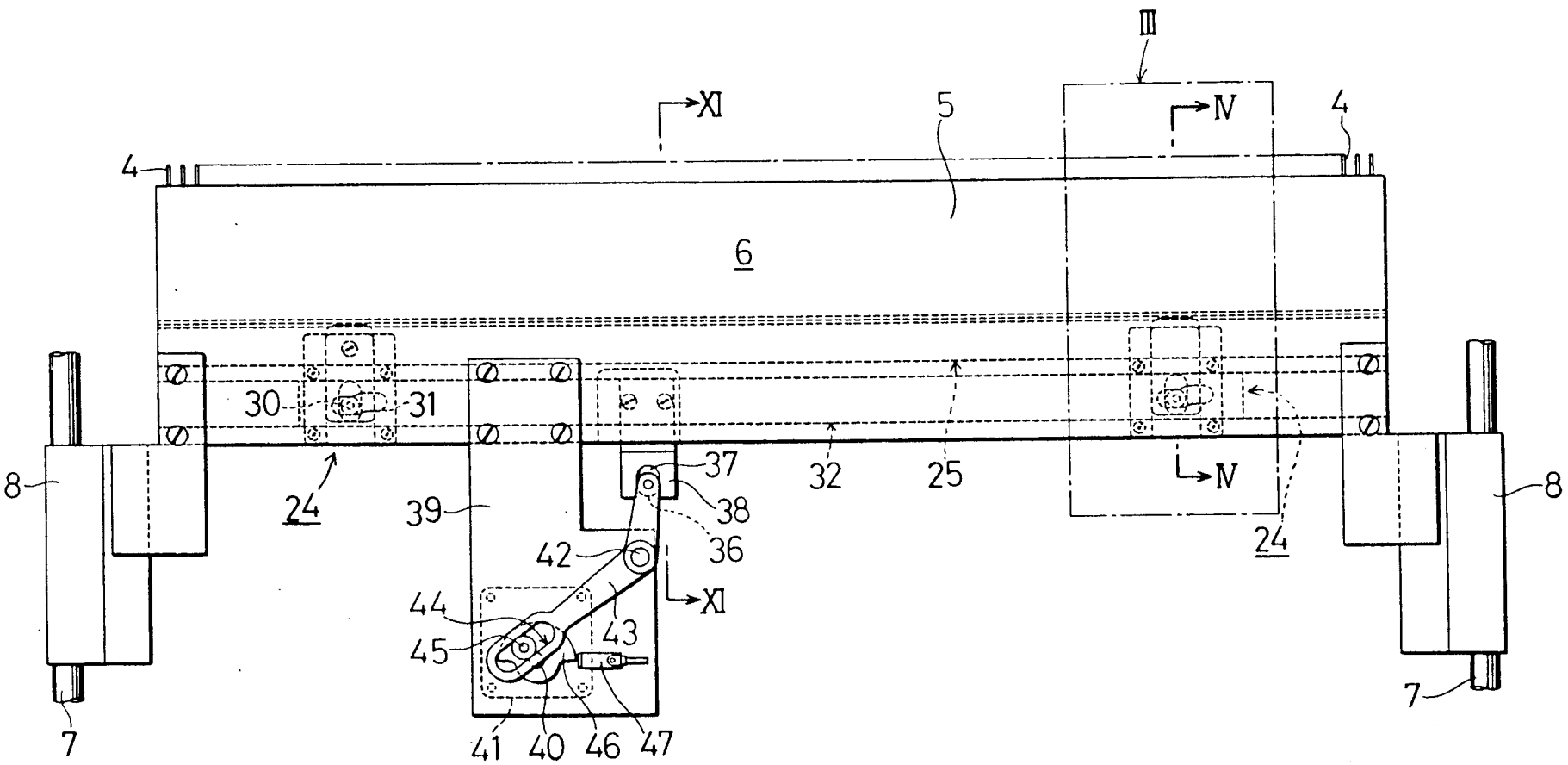
FIG. 2 is a front view showing a set-up comb.
Figure 4:
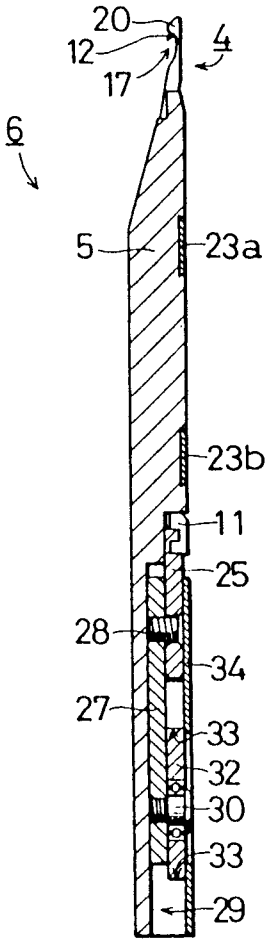
FIG. 4 is a section taken along line IV—IV in FIG. 2.

As FIGS. 2 to 4 illustrate, a lift bar 25 perpendicular to the row of needle grooves 21 is up and down movably disposed below the row of the grooves 21 in abutting relation with the back of the comb bed 5. The lift bar 25 is formed with a groove 26 for engagement with the engaging portions 13 of individual sliders 11, through which engagement the sliders 11 are connected to the lift bar 25. A pair of leg plates 27 for up and down movable support of the lift bar 25 are fixed to the lift bar 25 through a locking screw 28, with the leg plates 27 being up and down movably supported in a pair of guide grooves 29 cut suitably on the back side of the comb bed 5. In other words, the lift bar 25 is supported on the comb bed 5 through the pair of leg plates 27 for up and down movement along the back of the comb bed 5.

Each leg plate 27 has a rearwardly projecting cam follower 30. Disposed behind the pair of leg plates 27 is a grooved cam plate 32 having cam grooves 31 each engageable with a corresponding one of the cam followers 30 for allowing the lift bar 25 to move upward and downward.

The grooved cam plate 32 is supported transversely slidably along a guide groove 33 formed on the back of the comb bed 5, with the cam followers 30 received in the cam grooves 31 formed (in pair) in the cam plate 32.

The slider lifting device in the present embodiment is so arranged that when the grooved cam plate 32 is moved transversely back and forth a predetermined stroke on the comb bed 5, the lift bar 25 is moved vertically over a distance of $\alpha$. In turn, each of the sliders 11 connected to the lift bar 25 is moved vertically for a predetermined stroke of $\alpha$ in relation to both the corresponding needle body 10 and the comb bed 5. In FIGS. 3 and 4, reference numeral 34 designates a presser plate for retaining the lift bar 25 within the guide groove 33, and numeral 35 designates locking screws for the presser plate 34.

Next, a drive mechanism for moving the grooved cam plate 32 transversely back and forth on the comb bed 5 will be described with reference to FIG. 2. An arm plate 38 having a cam groove 37 of inverted U shape for receiving a cam follower 36 is mounted to the grooved cam plate 32. A bracket 39 is mounted to the comb bed 5, while mounted on the bracket 39 are a reduction-geared motor 41 (not shown) which has an output shaft 40, and a lever 43 pivoted at 42. The lever 43 is formed at one end with an elongate slot 44, the other end thereof being rotatably secured to the cam follower 36. A crank 46 having a crank pin 45 held in engagement with the elongate slot 44 is mounted to the output shaft 40 of the motor, the pin 45 of the crank 46 being connected to the cam groove 37 of the arm plate 38 through the lever 43 which is pivotally supported at 42 on the bracket 39. Shown by numeral 47 is a sensor for detecting the angle of rotation of the crank 46 for each half turn to stop the crank 46 at half turn intervals.

The slider lifting device constructed as above described of the present embodiment operates in the following manner.

Figure 12:
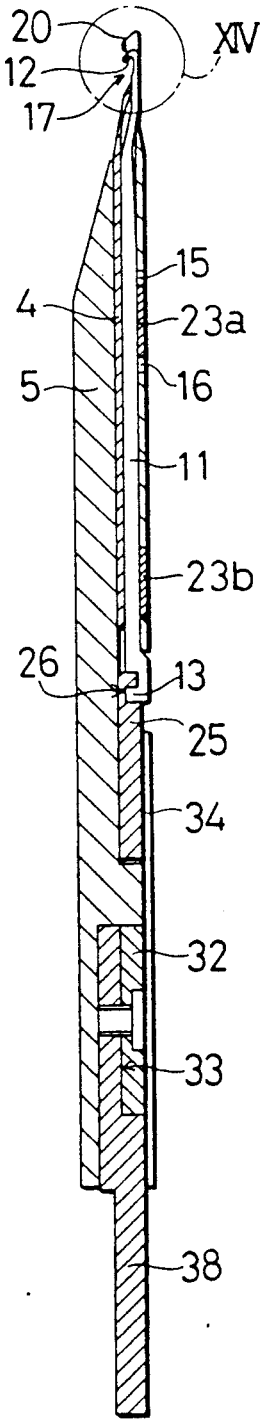
FIG. 12 is a section taken along line XI—XI in FIG. 2 showing the slider in lowered condition.

In the preferred embodiment, when the crank 46 is positioned at the rotation angle shown in FIG. 2, each cam follower 30 of the lift bar 25 is positioned at the left end of the corresponding cam groove 31 as shown, and the lift bar 25 is at its lowered position (FIG. 12). Then, when the crank 46 is rotated a half turn, the grooved cam plate 32 connected thereto through the lever 43 is moved leftward from its position shown in FIG. 2 (front view) and correspondingly the lift bar 25 is elevated to a predetermined elevated position through the cam followers 30 held in engagement with the cam grooves 31 of the grooved cam plate 32. Again, when the crank 46 is rotated a half turn, the grooved cam plate 32 is moved in the opposite direction and correspondingly the lift bar 25 is lowered to the above mentioned lowered position through the cam followers 30 engaged by the cam grooves 31 of the grooved cam plate 32. When the lift bar 25 is driven to move upward or downward in manner as above described, each slider 11 (the lower end of which is connected to the lift bar 25) is moved upward or downward for the predetermined stroke $\alpha$ in relation to both the needle body 10 and the comb bed 5. In this fashion the hook 12 of the slider 11 is moved upwardly from its exposed position for being received into the hook accommodating protrusion 20 of the needle body 10 (FIG. 11), or it is moved downwardly from the protrusion 20 to the exposed position in the recess 17 below the protrusion 20 (FIG. 12).

Figure 1:
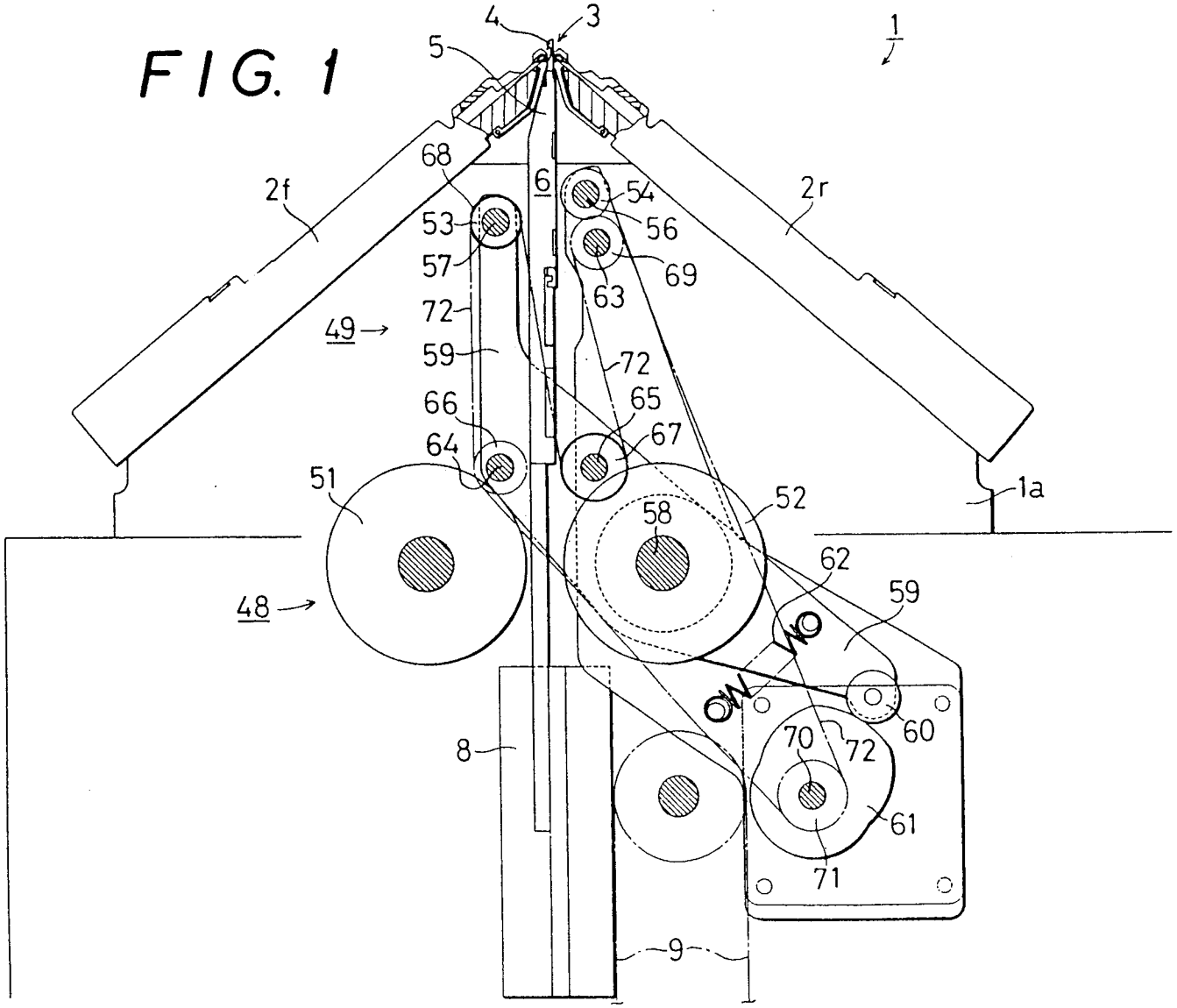
FIG. 1 is a vertical sectional side view showing one embodiment of the set-up means of the present invention.

In the flat knitting machine 1 of the present embodiment, as illustrated in FIG. 1, a main take-down device 48 and an auxiliary take-down device 49 are disposed below the needle beds 2*f*, 2*r*. These take-down devices 48 and 49 receive, at a level beneath the gap 3 but above the lowered set-up comb 6, a fabric 50 set up by the set-up means of the embodiment as the fabric is lowered along with the set-up comb 6 and for taking the fabric 50 down in place of the set-up comb 6.

The main take-down device 48 is of same construction as the one known in the art and, therefore, no detailed description or illustration is given of its construction herein. For the present purpose it will suffice to mention that the main take-down device 48 comprises a pair of rollers 51, 52 such that when the fabric 50 is lowered to a level below the clearance between the rollers 51, 52, the rollers 51, 52 operate to hold the fabric 50 between them in order to take the fabric down in place of the set-up comb 6 as it is released from the set-up comb 6.

Figure 18:
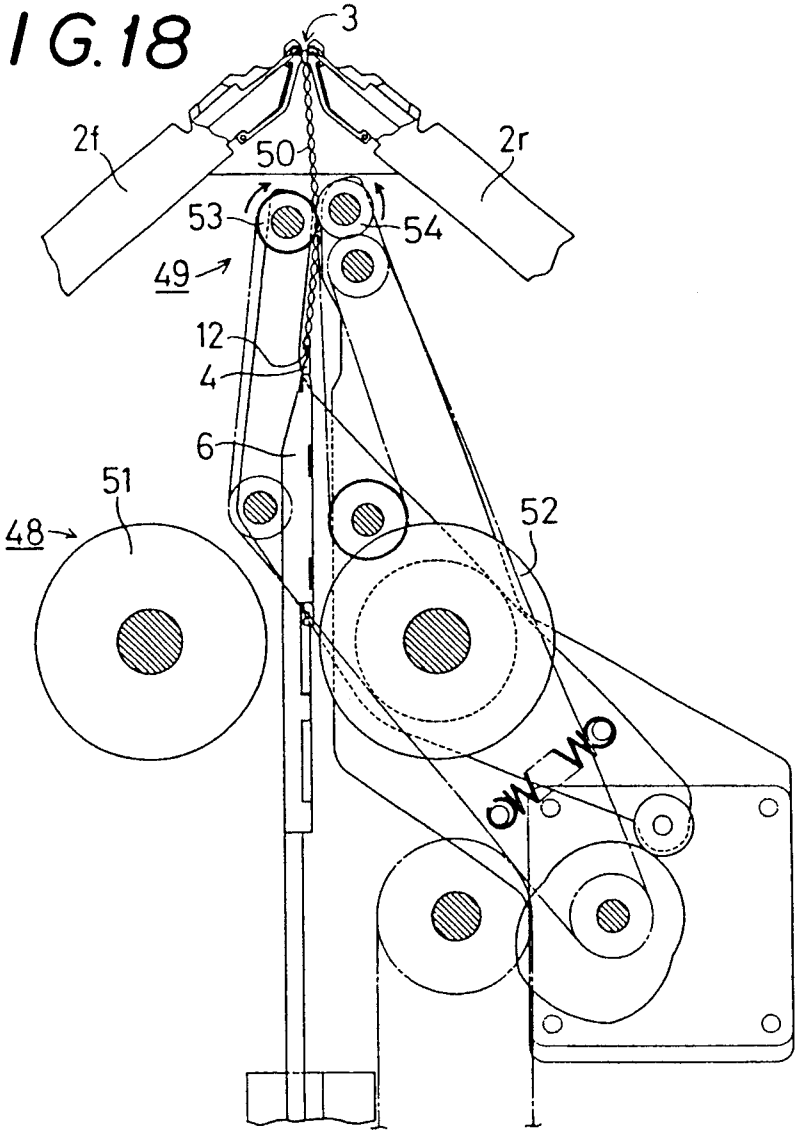
FIGS. 18 and 19 are side views showing a knitted fabric being lowered by the set-up comb.
Figure 19:
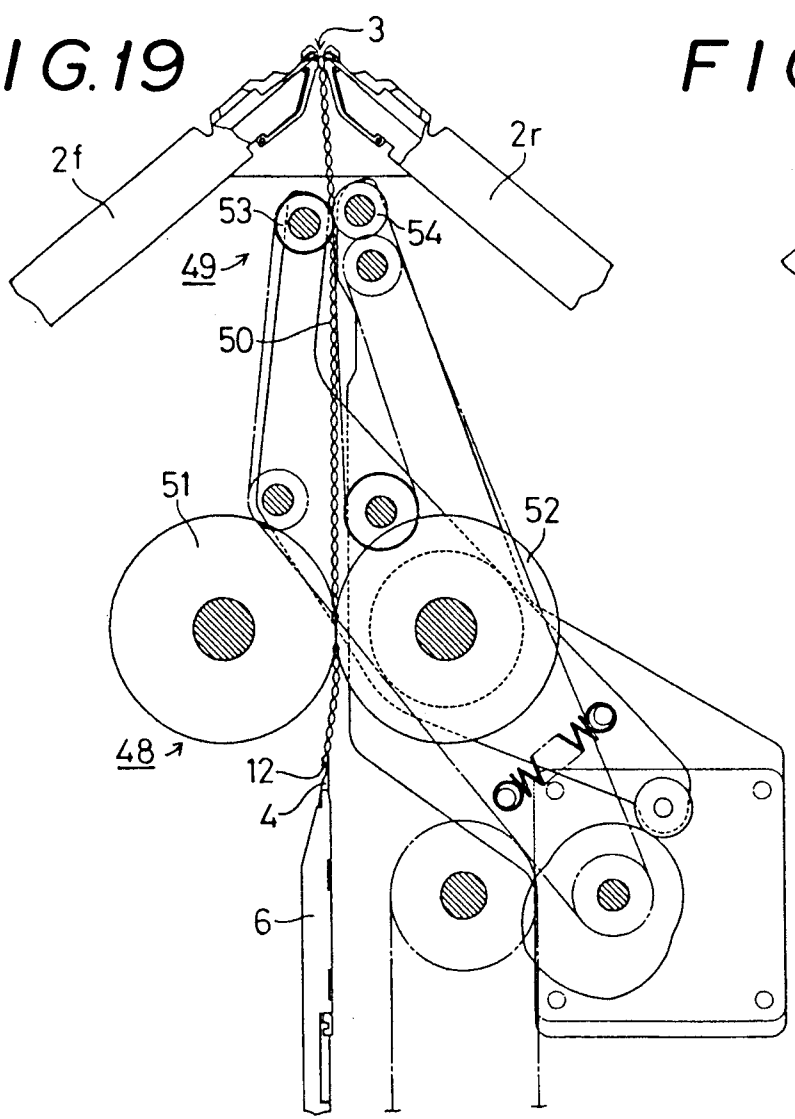
Figure 23:
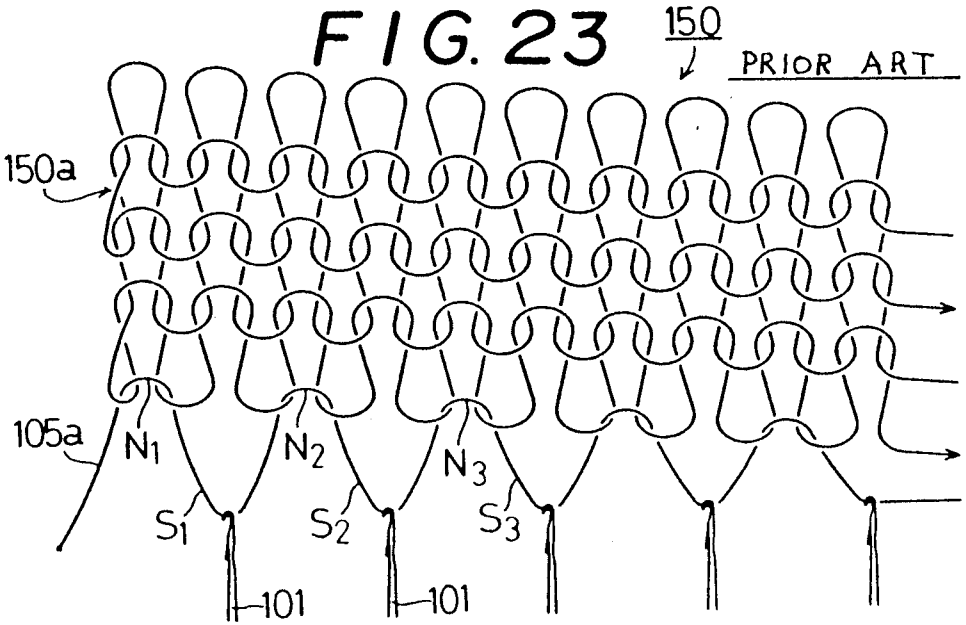
FIGS. 21 to 23 illustrate prior-art arrangement.
Figure 21:
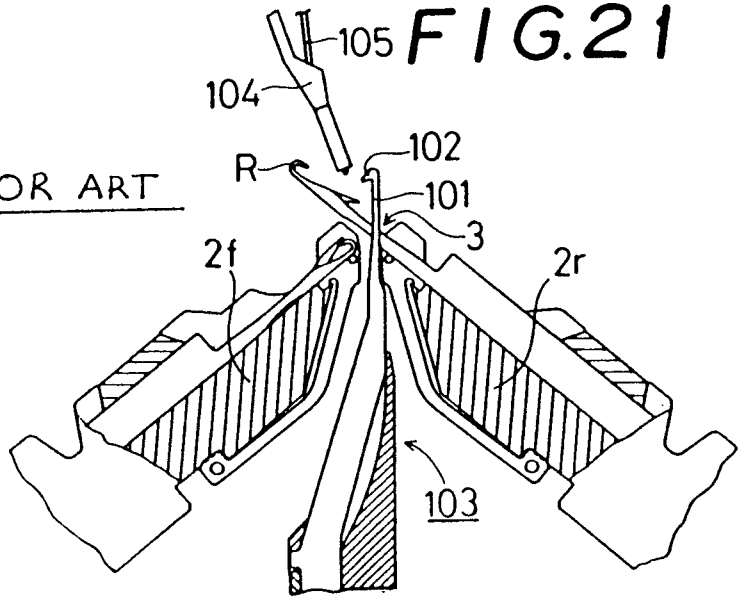
FIG. 21 PRIOR ART
Figure 22:
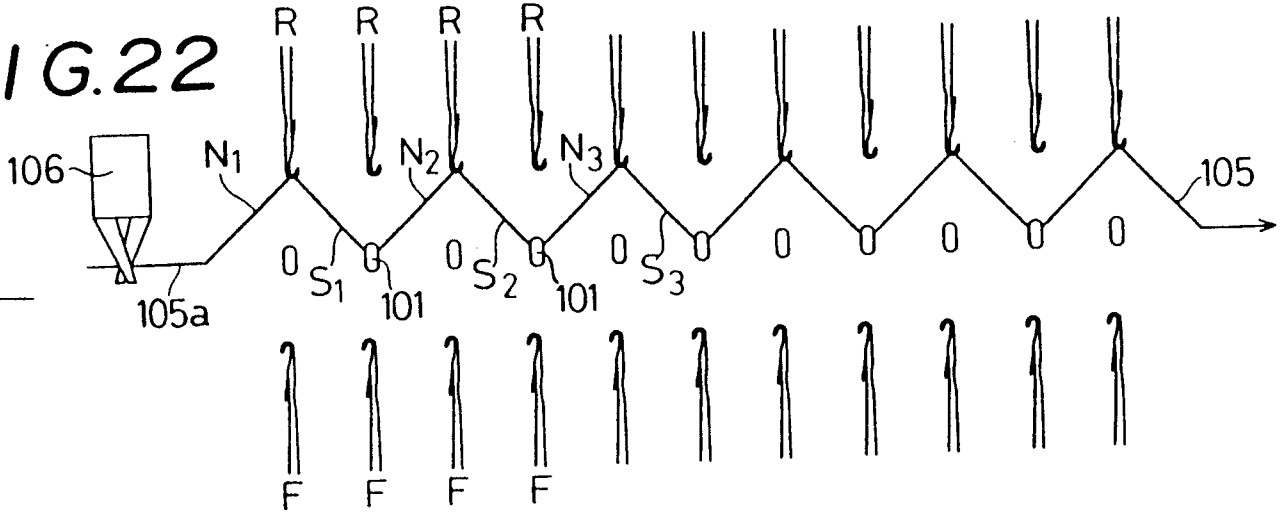
FIG. 22 PRIOR ART

The auxiliary take-down device 49 comprises a pair of rollers 53, 54 disposed immediately below the needle beds 2*f*, 2*r* and at a level above the pair of rollers 51, 52 of the main take-down device 48. The one roller 54 of the auxiliary take-down device 49 has its shaft 56 horizontally rotatably supported in position on the frames 1*a*, while a shaft 57 of the other roller 53 is rotatably supported across respective one-side free ends (operative points) of a pair of levers 59. The latter are pivotally supported on a shaft 58 of the roller 52 horizontally rotatably supported in position on the frames 1*a*. Therefore, the roller 53 is movable toward and away from the roller 54. At each of the other free ends (force points) of the levers 59 there is rotatably supported a cam follower 60 which is associated with a cam 61 rotatably supported on frame 1*a*. A spring 62 is suitably disposed between the lever 59 and the frame 1*a*, and the cam follower 60 is held in rolling contact with the cam 61 under the action of the spring 62. Therefore, by rotating the cam 61 for a change in its angle of rotation, the roller 53 can be displaced between a position at which the roller 53 is away from the roller 54 (FIG. 1) and a position at which the roller 53 is in contact with the roller 54 (FIGS. 18 to 20). When the pair of rollers 53, 54 are separated from each other, the set-up comb 6 can be moved upward and downward between the rollers 53, 54 (FIG. 1), whereas when the rollers 53, 54 are moved into contact with each other across the fabric 50, the fabric 50 is held between the rollers 53, 54 (FIGS. 18 to 20).

Further, in order to allow the fabric 50 to be lowered by the auxiliary take-down device 49 when the rollers 53, 54 are rotated in the direction of the arrow (see FIG. 18), while the fabric 50 is held between the rollers 53, 54 a roller rotation drive mechanism as described below is connected to the rollers 53, 54.

The shaft 56 of the one roller 54 is connected through a pair of intermeshing universal gears (not shown) to a reversing shaft 63 rotatably supported in position on the frames 1*a*. The reversing shaft 63 and the shaft 57 of the other roller 53 are interconnected by means of a timing belt 72 trained between timing pulleys 68, 69 fitted respectively on the shafts 63, 57 on one hand and a timing pulley 71 fitted on an output shaft 70 of a motor not shown on the other, via floating pulleys 66, 67 rotatably supported in position on the lever 59.

Next, the fabric setting-up method in accordance with the invention will be explained with respect to one example in which the method is carried out employing the set-up means of the above described preferred embodiment.

Figures 15A, 15B, 15C:
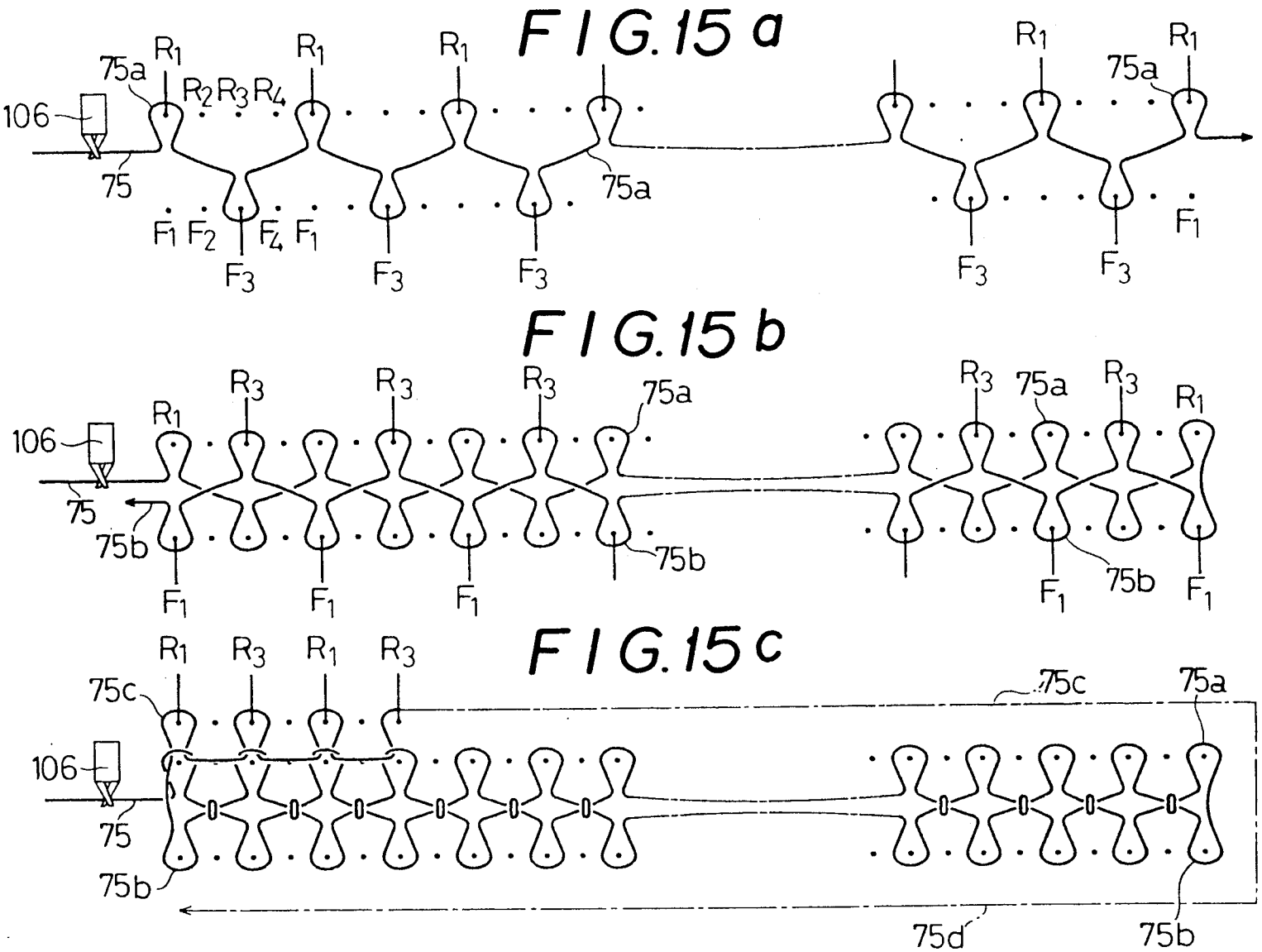
FIGS. 15*a* to 15*c* are views showing by way of example steps of set-up course forming according to the invention.

For setting up a fabric, the set-up comb 6 is held in a stand-by position below the gap 3 (as shown in FIG. 20, for example). Then, needles $R_1$ located at 3 needle intervals on the rear needle bed 2*r* and similarly spaced needles $F_3$ located on the front needle bed 2*f* (which are each opposed to a middle site between each adjacent two of the former needles $R_1$) are advanced to an operative position. After a forward-stroke set-up course yarn 75*a* is fed to the needles $R_1$, $F_3$ in zigzag pattern, the needles $R_1$, $F_3$ are retreated, whereby a ribbed course 75*a* of a "1×3 draw-off construction" is formed at the gap 3 (FIG. 15-*a*).

Then, individual 3-needle spaced needles $F_1$. $R_3$ located opposite the needles $R_1$, $F_3$ on which the forward-stroke ribbed course yarn 75*a* is laid are advanced to their operative position. After a back-stroke set-up course yarn 75*b* is fed to the needles $F_1$, $R_3$ on zigzag pattern, the needles $F_1$, $R_3$ are retreated, whereby a ribbed course 75*b* of a "1×3 draw-off construction" is formed at the gap 3. Thus, the forward- and back-stroke set-up course yarns 75*a*, 75*b* laid in zigzag pattern between the front and rear needle beds 2*f*, 2*r* cross each other at the gap 3 (FIG. 15 -B).

Figure 16A:
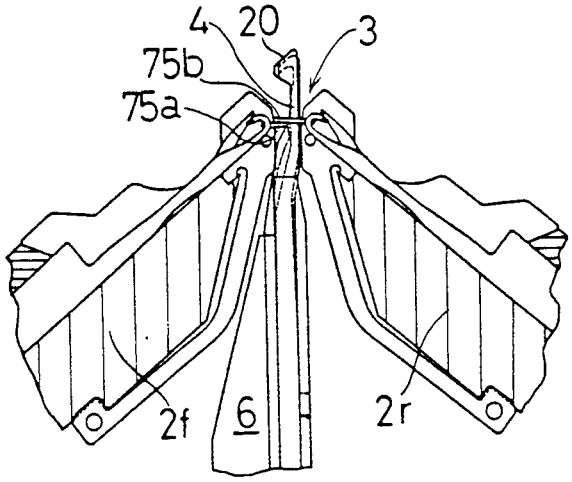
FIGS. 16*a* to 16*c* are side views showing steps of engaging behavior of the setting-up needle relative to set-up course yarn.
Figure 16B:
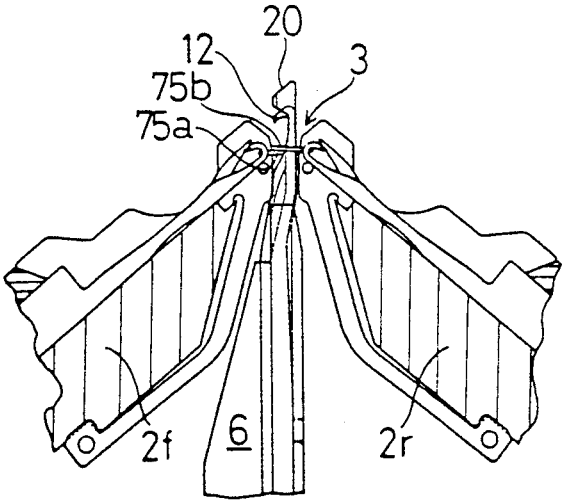
Figure 16C:
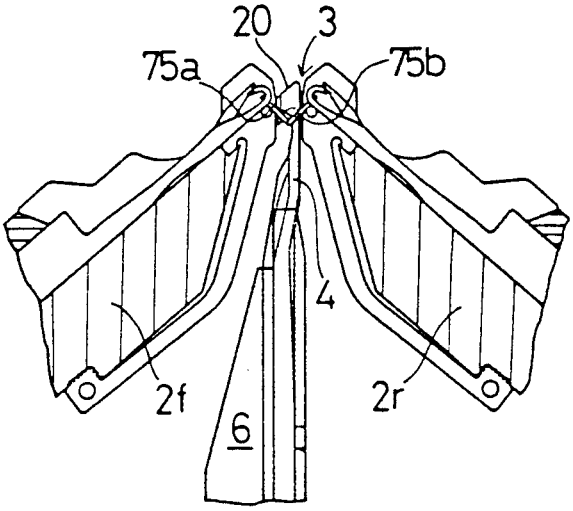

Once such ribbed courses 75*a*, 75*b* are formed at the gap 3, the set-up comb 6 is elevated, whereupon the hook accommodating protrusion 20 at the upper end of each of the setting-up needles 4 is guided by the sloped surface at the top 20*b* thereof to a level above a corresponding crossing portion of the ribbed course yarns 75*a*, 75*b* passing through a clearance behind the crossing portion of the yarns 75*a*, 75*b* (FIG. 16 - *a*).

By the time this condition is reached, the hook 12 portion of the slider 11 is usually received in the hook accommodating protrusion 20, because the hook 12 is received in the hook accommodating protrusion 20 when the fabric 50 is disengaged from the hook 12 during a former set-up stage.

When the slider 11 is lowered for the predetermined stroke in relation to the needle body 10 and the comb bed 5, the hook 12 housed in the hook accommodating protrusion 20 is withdrawn therefrom for being exposed in the recess 17 at the front side of the needle body 10 (FIG. 16 - *b*).

Figure 17:
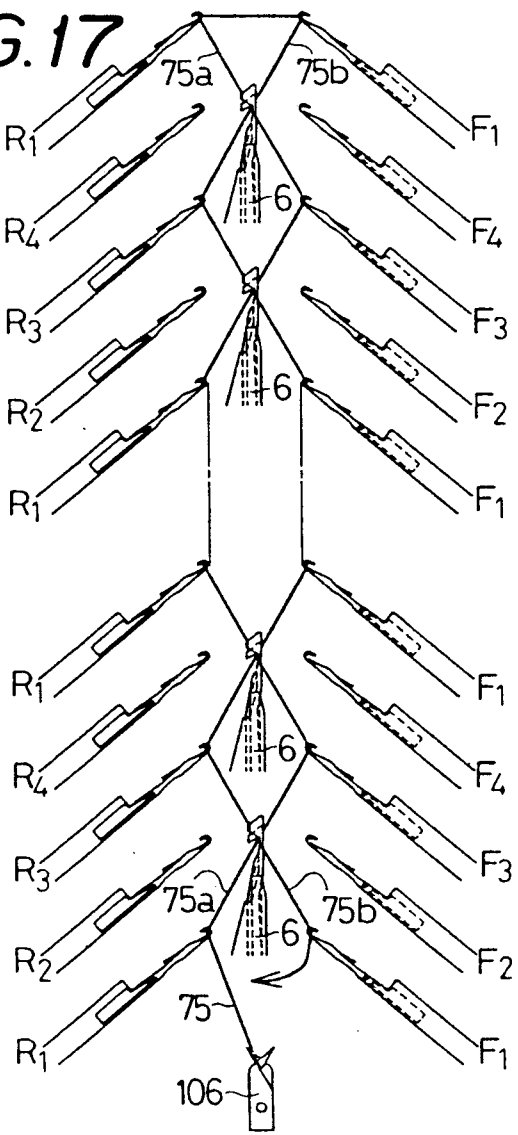
FIG. 17 is a view showing a double-stroke ribbed-course set-up yarn engaged by setting-up needles as viewed from above at an angle.

Then, the set-up comb 6 with hooks 12 exposed in the recess 17 is lowered, whereupon the hooks 12 of the slider 11 catch the set-up course yarns 75*a*, 75*b* at crossing portions thereof (FIG. 17); and the set-up comb 6 in that condition is lowered to a position at which the upper end portions (hook accommodating protrusions 20) of the setting-up needles do not interfere with yarn feeder passage (FIG. 16 - *c*).

When such condition is reached, as FIG. 15 - *c* illustrates, set-up yarns 75*c*, 75*d* for one double-stroke course succeeding to the end of the above mentioned back-stroke set-up course yarn 75*b* are fed to the needles $R_1$, $R_3$, $F_1$, $F_3$ on the rear and front needle beds for being knitted into a tubular course, beginning from the needle $R_1$ on which the beginning portion of the first-stroke ribbed course 75*a* is placed, and thereafter a fabric succeeding to the set-up course 75*c*, 75*d* may be knitted.

In this way, a fabric can be set up according to the method of the invention. During forming the set-up course 75*c*, 75*d* and succeeding courses for knit fabric 50, the set-up comb 6 is gradually lowered in proportion to the speed at which fabric 50 is knitted, whereby knitting operation for fabric 50 can be successfully performed while keeping both the set-up course 75*c*, 75*d* and the fabric 50 being knitted in succession thereto under a desired tension (FIGS. 18 and 19).

The set-up means of the embodiment is so arranged that, when individual sliders 11 are elevated by means of the slider lifting device 24 over the predetermined stroke $\alpha$ in relation to both the corresponding needle bodies 10 and the comb bed 5 upon fabric 50 having been knitted to a desired length, the set-up course yarns 75*a*, 75*b* which are engaged by individual hooks 12 strike against the underside 20*a* of the protrusions 20 and thus are disengaged from the hooks 12 when the hooks 12 are received into the corresponding protrusions 20. Since the underside 20*a* of each hook accommodating protrusion 20 is forwardly upward sloped, the set-up course yarns 75*a*, 75*b* disengaged from the hooks 12 are not caught by the protrusions 20. Accordingly, the lower end of the fabric 50 is cast off the set-up comb 6 (FIG. 20).

When the set-up method according to the invention is carried out using an elasting yarn as the set-up course yarn, upper ends of individual setting-up needles 4 engaging the set-up course yarns 75*a*, 75*b* can be very smoothly lowered to a level below the gap 3 at which level they do not interfere with advance of the knitting needles. Further, during knitting operation for fabric 50, a uniform and moderate elastic tension is applied to the fabric 50 over its entire width so that the knitted fabric 50 can be smoothly lowered without involving any loop dropping.

In FIGS. 18 to 20, there is shown a case in which the set-up comb 6 is disengaged from the fabric 50 when the lower end of the fabric 50 is lowered to a level below the pair of rollers 51, 52 of the main take-down device 48. With the set-up means of the present invention, however, simply by elevating sliders 11 in relation to the corresponding needle bodies 10, so that hooks 12 of individual sliders 11 which engage the set-up course yarns 75*a*, 75*b* are received into the hook accommodating protrusions at the upper end of the corresponding needle bodies 10, it is possible to allow the set-up course end of the fabric 50 engaged by hooks 12 to be cast off the set-up comb 6 irrespective of the upper end (hook accommodating protrusion 20) of the set-up comb 6 or without the necessity of lowering the lower end of the fabric 50 to, for example, a level below the pair of rollers 53, 54 of the auxiliary take-down device 49. This means that the set-up comb 6 can be disengaged from the fabric 50, wherever necessary, however short the set-up length of the fabric 50 may be.

In the case where, as shown by way of example, the auxiliary take-down device 4 is disposed immediately below the gap 3 and above the main take-down device 48, the knitted fabric 50 may be lowered by means of the set-up comb 6 to a level below the pair of rollers 53, 54 of the auxiliary take-down device 49 (FIG. 18). There, the set-up comb 6 can be disengaged from the fabric 50 while the fabric 50 is held between the rollers 53, 54, the fabric 50 being thus lowered by the auxiliary take-down device 49 to a position within the operative zone of the rollers 51, 52 of the main take-down device 48.

As is apparent from the foregoing description, the set-up method of the invention is such that a knitted fabric is lowered by causing the set-up comb to act on a previously formed double-stroke ribbed course of the fabric from behind at crossing portions of the ribbed course yarns laid over the gap between the front and rear needle beds. Therefore, according to the present set-up method, the set-up course is formed in such a way that a starting set-up yarn loop is formed outside the position of the one setting-up needle by which the lower end of the knitted fabric is lowered at a site nearest to the set-up yarn feeding end, and that another double-stroke set-up course (tubular course) is knitted in succession to the set-up loop formed outside the one setting-up needle, such that the subsequent fabric knitting takes place in succession to the tubular course. Therefore, the loop formed outside the one setting-up needle is not subject to be stretched by the set-up comb more than other loops to be lowered by other setting-up needles, when it is lowered by the one setting-up needle. Accordingly, a uniform tension is applied to the fabric being engaged by the set-up comb over its entire width.

According to the method of the present invention, therefore, it is possible to knit a fabric without involving such deformation as has often been encountered with prior-art methods and without such a trouble as loop dropping at portions adjacent fabric selvage which has often been experienced with the prior-art methods.

Also, according to the set-up method of the present invention, in which the set-up comb is caused to act on the fabric at crossing portions of a previously formed double-stroke set-up course laid over the gap between the front and rear needle beds, in order to lower the fabric, the set-up comb need not be projected above the gap serving as a feeder passage when set-up yarn is fed to needles. Therefore, the present method provides various advantages over conventional methods. That is, a double-stroke set-up course (ribbed course) previously formed of yarn fed from a yarn feeder located at a desired position is hooked by the set-up comb and lowered to a level beneath the gap, whereby a faric can be set up. When the set-up comb is to be projected above the gap, it is not necessary to arrange for all yarn feeders to be held in stand-by position outside the set-up comb range in order to avoid their possible collision with the set-up comb, as has been the case with the conventional methods. Setting-up needles of the set-up comb can be constructed to be of short length, because they are capable of hooking set-up course yarn even if they are short; through such arrangement it is possible to disengage the set-up comb from individual loops smoothly.

Being constructed as above described and adapted to operate in manner as above described, the set-up means of the preferred embodiment can be advantageously employed in carring out the set-up method of the present invention.

The set-up means of the preferred embodiment is of such arrangement that by upwardly and downwardly moving sliders slidably combined with corresponding needle bodies in relation to the needle bodies, so that the individual hook portions at the upper ends of the corresponding sliders are withdrawn from and received into the corresponding protrusions, it is possible to facilitate replenishment of set-up yarns and disengage the set-up comb from the set-up course loops. Therefore, the present set-up means permits accurate and smooth engagement and disengagement of the set-up comb relative to the fabric. In addition, the set-up means has good advantage in structural strength over the known arrangement.

Further, the set-up means of the preferred embodiment requires no such loop casting-off means as is usually employed in the prior art arrangement which must be caused to act upon the fabric at a level above the set-up comb. Therefore, even if the length of the fabric is short, the set-up comb can be disengaged from the lower end of the fabric.

What is claimed is:

1. A set-up method for setting up a fabric on a flat knitting machine having front and rear needle beds comprising:

a) forming a double-stroke set-up course as $1\times1$ rib pattern omitting each of 3 needles so that a forward-stroke ribbed-course set-up varn and a back-stroke ribbed-course set-up yarn form a zigzag pattern crossing each other between the front and rear needle beds above a gap between the needle beds, b) causing needles of a set-up comb to act on the crossing portions of the two set-up yarns so as to lower the crossing portions of the double-stroked ribbed course yarn to a level below the gap, and c) feeding one of the double-stroke set-up course yarns to the needles on which the one double-stroke course yarns are laid so that at the terminating end of the back-stroke ribbed course a tubular course is knitted to which a fabric is knitted.

2. A set-up method for setting up a fabric on a flat knitting machines having front and rear needle beds as set forth in claim 1, wherein said set-up yarns have stretch characteristics.

* * * * *